United States Patent [19]

Toshimitsu et al.

[11] Patent Number: 4,757,349

[45] Date of Patent: Jul. 12, 1988

[54] CLEANING DEVICE AND PROCESS FOR USE IN IMAGE FORMING APPARATUS

[75] Inventors: Kenshi Toshimitsu, Kawasaki; Seiichi Kobayashi, Mitaka, both of Japan

[73] Assignee: Kabushiki Kaisha Toshiba, Kawasaki, Japan

[21] Appl. No.: 853,167

[22] Filed: Apr. 17, 1986

[30] Foreign Application Priority Data

Apr. 17, 1985 [JP] Japan ..... 60-82793

[51] Int. Cl.[4] ..... G03G 21/00

[52] U.S. Cl. ..... 355/15; 430/125

[58] Field of Search ..... 355/15, 3 R; 118/652; 430/125; 15/256.51, 256.52, 256.5

[56] References Cited

U.S. PATENT DOCUMENTS 3,552,850 1/1971 Royka et al. .
4,264,191 4/1981 Gerbasi et al. .
4,519,698 5/1985 Kohyama et al. .

FOREIGN PATENT DOCUMENTS 2324749 11/1974 Fed. Rep. of Germany .
53-15377 5/1978 Japan .
60-50569 3/1985 Japan ..... 355/15

*Primary Examiner*—A. T. Grimley
*Assistant Examiner*—J. Pendegrass
*Attorney, Agent, or Firm*—Cushman, Darby & Cushman

[57] ABSTRACT

A cleaning blade and process for use in an image forming apparatus wherein the blade removes residual developer from a photosensitive member. The cleaning blade can be in close contact with the photosensitive member. The blade extends substantially at right angles to the direction in which the photosensitive member moves. It has a lubricant layer formed on both end portions in the longitudinal direction of the blade, which forms part of a surface contacting the photosensitive member.

9 Claims, 6 Drawing Sheets

CLEANING DEVICE AND PROCESS FOR USE IN IMAGE FORMING APPARATUS

BACKGROUND OF THE INVENTION

The present invention relates to a cleaning device for use in an image forming apparatus.

In general, in an image forming apparatus such as during the completion phase of a copying cycle, any electronic copying apparatus, an untransferred toner (residual developer) remaining on the surface of a photosensitive drum is scraped off by means of a cleaning blade (cleaning member).

If a great frictional force is produced between the photosensitive drum and the cleaning blade, the drum surface may be damaged or filmed with the toner, or the blade may be burred due to stress, failing to keep in contact with the drum. Moreover, an electrostatic effect may be caused by the friction and impair a uniform surface potential during a charging process, resulting in uneven or irregular images or fog. The frictional force can be reduced by lowering the cleaning blade pressure. If this is done, however, the cleaning blade cannot fulfill its primary function, i.e., cleaning the photosensitive drum, thereby causing filming.

Conventionally, therefore, lubricant has been added, by way of trial, to the developer for the purpose of reducing the frictional force between blade and drum. However, the toner used therefor may be lowered in fixing capability by the lubricant therein, or the photosensitive drum may be coated with a thin toner film. Thus, the image quality is subject to substantial variations and mades this suggested arrangement very impractical.

Also, other lubricants have hitherto been tried as a coating material to be applied to the surface of the photosensitivie drum. There has also not been any method of restricting a lubricant film on the drum to a thickness such that the electrostatic characteristic of the drum not is lowered, that is, a thickness of hundreds of angstroms or less. Moreover, there have been attempts to improve the material of the blade by using one with a low coefficient of friction. However additives impair other desirable characteristics of the blade, especially its mechanical strength.

In the prior art initially setting the photosensitive drum usually produces great stress between the blade and drum, consequently subjecting the blade to burr and damaging the drum. To avoid this, an operator or serviceman sprays lubricant powder, such as polyvinylidene fluoride, to a thickness of 5 micrometers on the drum, thereby easing the friction between drum and blade. This manual work is troublesome and lacks in reliability. For example, the operator may touch the drum during the work.

Alternatively, a toner layer may be formed on the photosensitive drum at the time of the initial drum setting. According to this system, the drum is first rotated, and at the same time, a toner layer is formed on the drum during period A with the developing bias as an inverse bias, and the blade is then brought into contact with the drum during period B with starts during the second revolution of the drum, as shown in FIG. 1. Thus, the toner layer is utilized as a lubricant. In this case, however, a high frictional resistance is still produced on that portion of the contact region between drum and blade with no toner layer, causing burr of the blade or damaging the photosensitive drum.

SUMMARY OF THE INVENTION

The object of the present invention is to provide a cleaning device and process for use in an image forming apparatus with a cleaning blade which eliminates the aforementioned difficulties despite a relatively simple construction.

In order to achieve the above object, a cleaning device for use in an image forming apparatus according to the present invention comprises a cleaning blade which can move relative to the photosensitive member, extends substantially at right angles to the direction in which it moves relative to the photosensitive member, and has a lubricant layer formed on both end portions in the longitudinal direction of the blade, which forms part of a surface contacting the photosensitive member.

Also in the initial setting stage, a process is used wherein the blade is coated with lubricant powder i.e., toner whereby frictional stress is reduced and the blade is protected against burr.

Since the residual toner is gradually removed by means of a high-accuracy edge portion of the blade, the photosensitive drum can be protected against filming. The gradual cleaning process permits an intimate contact between drum and blade, thus preventing burr of the blade.

In the initial setting process, which is subject to the greatest stress, burr is prevented by the agency of the lubricant.

The trouble of the serviceman can be eased for higher reliability.

According to the present invention described in detail herein, there may be provided a cleaning device for use in an image forming apparatus which can produce satisfactory images despite a simple construction, eliminating burr of blade, cleaning errors, filming, etc.

DETAILED DESCRIPTION OF THE PREFERRED EMBODIMENTS

Figure 1:
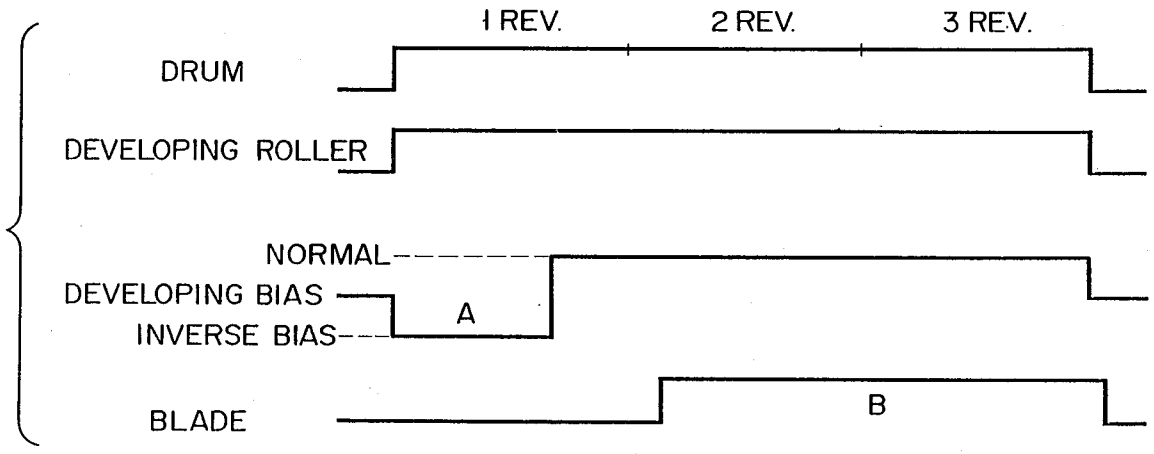
FIG. 1 (PRIOR ART)
FIG. 1 is a time chart illustrating a process of initial setting.
Figure 2:
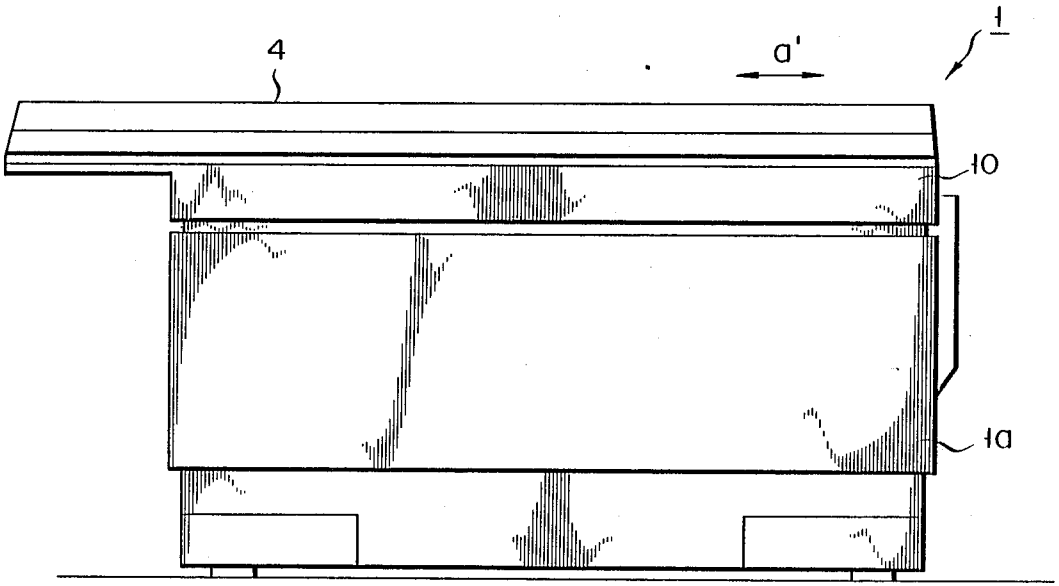
FIG. 2 shows an outline of an apparatus using a cleaning blade according to an embodiment of the present invention.
Figure 3A:
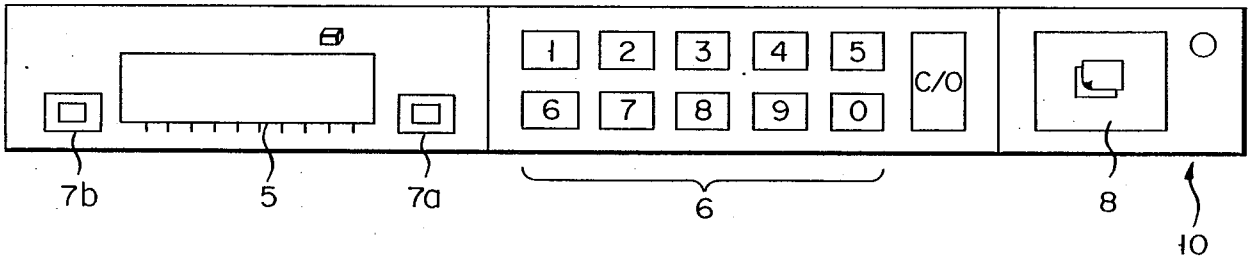
FIG. 3A shows a control panel of the apparatus.
Figure 3B:
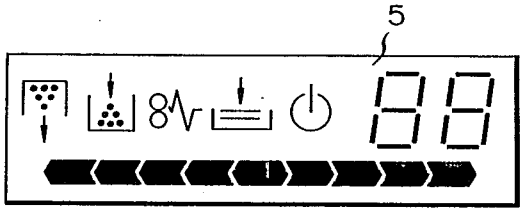
FIG. 3B is an enlarged view showing part of FIG. 3A.
Figure 4:
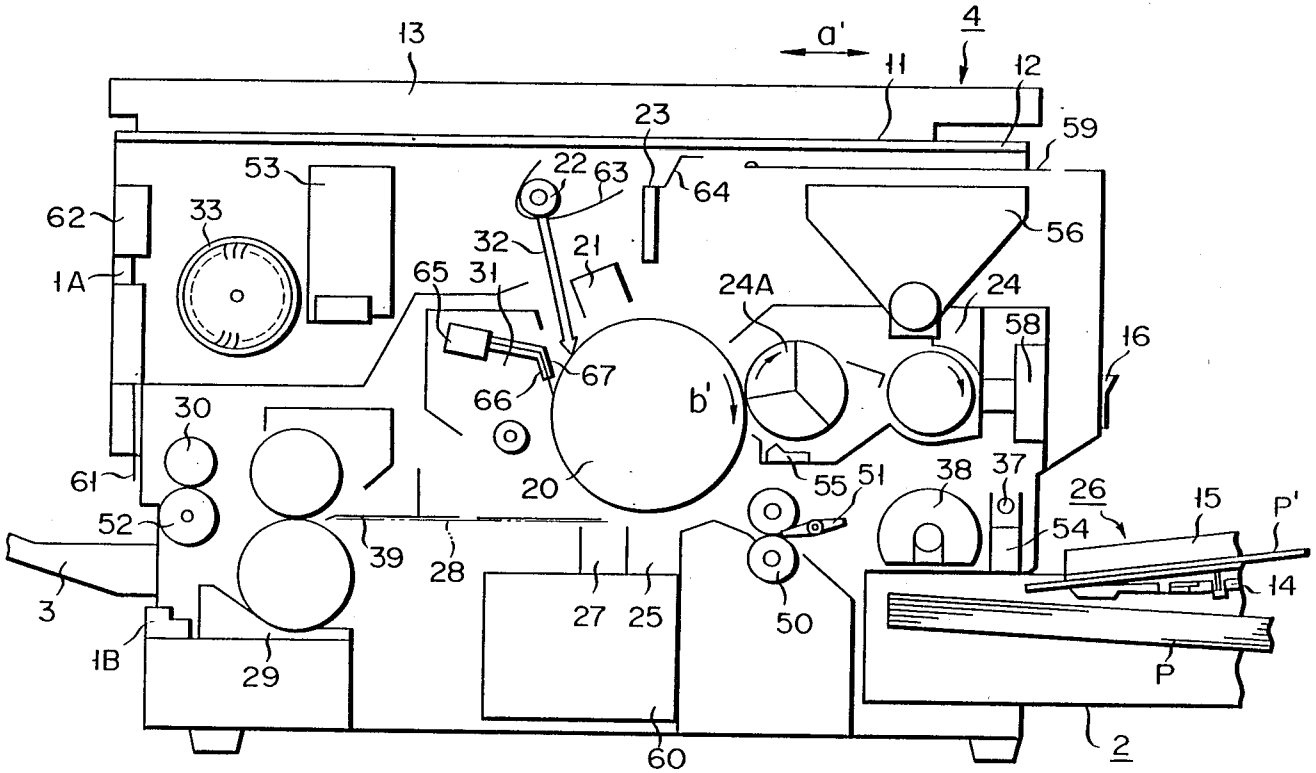
FIG. 4 is a schematic sectional view of the apparatus.

An embodiment of the present invention will now be described in detail with reference to the accompanying drawings. FIGS. 2 to 4 show an outline of an electronic copying apparatus as an image forming apparatus using a cleaning blade according to the invention. In these drawings, numerals 1, 2 and 3 designate, respectively, an apparatus housing containing a copying mechanism, a paper cassette attached to the right-hand side portion of the housing, and a tray attached to the left-hand side portion of the housing. Housing 1 carries thereon original table 4 which can reciprocate horizontally or in the direction of arrow a' of FIGS. 2 and 4. Disposed on the front end edge portion of the top surface of housing 1 is control panel 10 which is provided with display 5 and input keys including ten-keys 6, exposure setting keys *7a* and *7b*, print key 8, etc.

Original table 4 comprises original carrier plate (glass plate) 12 for carrying original 11, and original cover 13 overspreading the plate.

As shown in FIG. 4, cassette cover 14 of paper cassette 2 serves also as sheet-bypass guide 15 along which sheet P' is manually fed as required. In FIG. 4, numeral 16 designates a power switch.

Referring to FIG. 4, the internal mechanism of the electronic copying apparatus will now be described. Numeral 20 designates a photosensitive drum disposed substantially in the center of apparatus housing 1. Drum 20 is driven in the direction of arrow b' in synchronism with original table 4 by a drive mechanism (not shown). First, the surface of drum 20 is uniformly charged by main charger 21, and an original image, uniformly irradiated by exposure lamp 22, is projected on drum 20 by means of converging light transmitter (trademark: Selfoc Lens Array) 23, thus forming an electrostatic latent image. Then, the latent image is developed into a toner image by developing unit 24 including developing roller 24A, and is delivered to transfer charger 25.

Sheet P or P', supplied automatically or manually, is fed by sheet feeder 26. Then, the toner image, previously fomed on drum 20, is transferred to the surface of sheet P (P') by transfer charger 25. Thereafter, sheet P (P') is separated from drum 20 by separation charger 27 utilizing AC corona discharge, and fed along transport path 28. The toner image is fused to sheet P (P') by fixing unit 29, and the sheet is discharged into detachable tray 3 by exit rollers 30. Meanwhile, the residual toner, remaining on the surface of drum 20 after the transfer of the toner image to the sheet, is removed by cleaning unit 31. The potential on drum 20 is lowered below a predetermined level by bypass slit beam 32 which diverges from a light beam from exposure lamp 22. Thus, the apparatus is ready for the next cycle of copying operation.

Numeral 33 denotes a fan as a cooling unit, which discharges heat generated from heat generating parts in the apparatus, including exposure lamp 22 and fixing unit 29.

Inside apparatus housing 1, upper and lower frames are pivotally mounted on shaft 37 at one end portion so that the respective other end portions of the frames can be swung open to form a desired angle of e.g. 25 degrees between them. The upper frame is mounted, by suitable means, with main charger 21, converging light transmitter 23, exposure lamp 22, developing unit 24, cleaning unit 31, and discharge lamp 32 which surround photosensitive drum 20. Also, the upper frame is fitted with cooling fan 33, paper-supply roller 38 of sheet feeder 26, and original table 4. The upper frame and those members mounted thereon constitute upper unit 1A. The lower frame is fitted, by suitable means, with paper cassette 2, transfer charger 25, separation charger 27, transport path 28, guide plate 39, fixing unit 29, exit rollers 30, and tray 3, thus constituting lower unit 1B. Units 1A and 1B can be separated from each other substantially along transport path 28 by releasing a housing lock mechanism (not shown) after swingingly removing front cover 1a of housing 1. Thus, if path 28 is jammed with sheet P (P'), the sheet can be removed with ease.

In FIG. 4, numeral 50 designates a pair of aligning rollers which correct the skew of the leading edge of sheet P automatically fed from cassette 2 or manually fed sheet P', and direct the sheet toward transfer charger 25 in synchronism with the process of forming the toner image on drum 20. Numeral 51 denotes a paper sensing switch located just short of rollers 50.

In FIG. 4, there are also shown paper-supply switch 52, total counter 53, paper-empty switch 54 for detecting the absence of sheets P in paper cassette 2, doctor 55 for regulating the thickness of a developing agent layer in developing unit 24, toner cartridge 56, toner density sensor, and top cover 59 of the developing unit. Original table 4 cannot move unless cover 59 is put on. Cover 59 has an opening through which cartridge 56 and developing unit 24 can be loaded or unloaded for replacement.

Numeral 60 designates a high-voltage transformer whose casing is formed integrally with a shielding case for transfer and separation chargers 25 and 27. Also, FIG. 4 shows de-electrification brush 61, grip 62 for handling upper unit 1A, reflector 63 backing exposure lamp 22, and auxiliary reflector 64.

Numeral 65 designates a weight, whereby cleaning blade 66, as a cleaning member of cleaning unit 31, is brought into contact with photosensitive drum 20 under a predetermined pressure. Weight 65 is driven by a solenoid (not shown) to operate blade 66. Numeral 67 denotes a blade holder for holding the cleaning blade.

Reflectors 63 and 64 and converging light transmitter 23 are assembled as a single unit.

Figure 5:
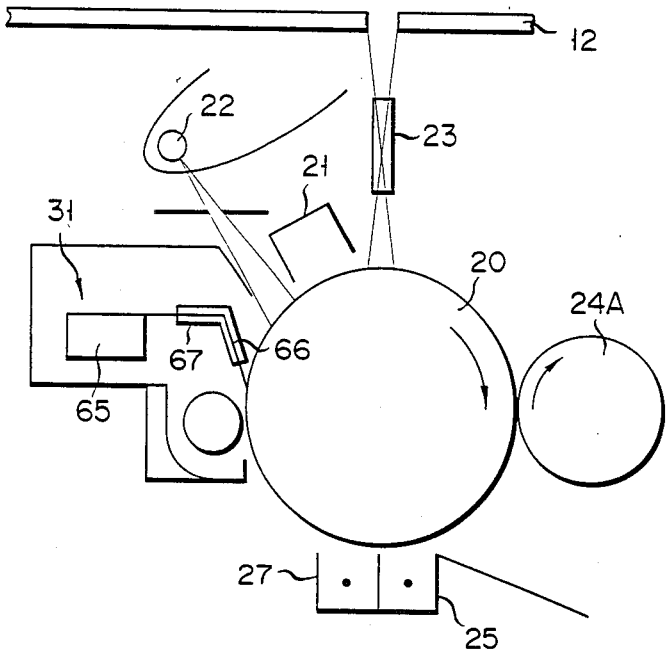
FIG. 5 is a sectional view showing the cleaning blade and its surroundings.
Figure 6:
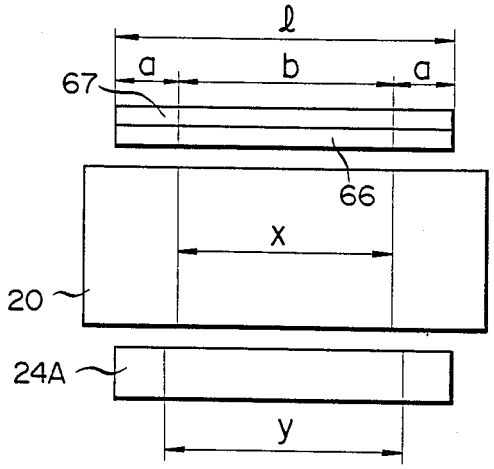
FIG. 6 is a plan view showing the relationships between a photosensitive drum, cleaning blade, and developing roller.

Referring now to FIGS. 5 and 6, the relationships between cleaning unit 31, photosensitive drum 20, developing roller 24A and their surroundings will be described.

In FIG. 5, unit 31 and roller 24A are located on the left- and right-hand sides, respectively, of drum 20. An optical system, including exposure lamp 22 and converging light transmitter 23, is arranged over the photosensitive drum. Numerals 21, 25 and 27 denote a main charger, transfer charger, and separation charger, respectively.

Cleaning unit 31 is mainly composed of cleaning blade 66 retained by blade holder 67, and weight 65 attached to one end of holder 67.

The relationships between photosensitive drum 20, cleaning blade 66, and developing roller 24A are as shown in the plan view of FIG. 5. In FIG. 6, region x is a visible-image region which is conducive to the image formation, while the remaining side portions are nonvisible-image region irrelevant to the image formation. Region y of roller 24A is a region over which a developing agent is transported. Usually, length 1 of blade 66 is longer than the width of regions x and y. Hereupon, that portion b of blade holder 67 or blade 66 thereon which corresponds to visible-image region x, with respect to its longitudinal direction, is referred to as a visible-image corresponding region, and remaining side portions a as nonvisible-image corresponding regions.

The construction of the cleaning unit of the present invention will now be described in detail.

Figure 7:
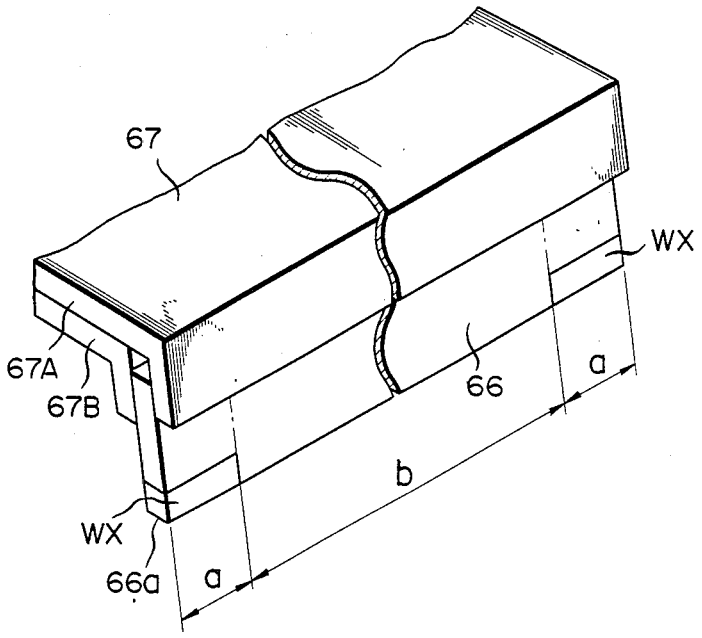
FIG. 7 is an enlarged perspective view schematically showing the cleaning blade.

In this embodiment, as shown in FIG. 7, platelike cleaning blade 66 is held between hanging portions of blade holder plates 67A and 67B which constitute blade holder 67 as holding means. Nonvisible-image corresponding regions a of blade 66 are both coated with a lubricant WX. The range of application of lubricant WX covers partial regions including at least part of the distal end face of blade 66 which is to be brought into contact with the photosensitive drum. In FIG. 7, numeral 66*a* designates an edge portion of blade 66.

The application range of lubricant WX is not limited to that of the above described embodiment. For example, the lubricant may be applied to the whole area of regions a of cleaning blade 66, or to only part of the regions with respect to the longitudinal direction of the blade.

The operation of the aforementioned apparatus will now be described.

Photosensitive drum 20 is driven in the direction of arrow b' in synchronism with original table 4 by the drive mechanism (not shown). Then, it is uniformly charged by main charger 21, and an original image, uniformly irradiated by exposure lamp 22, is projected onto drum 20 by converging light transmitter 23, thus forming an electrostatic latent image on the drum. The latent image, formed in this manner, is developed into a toner image by developing unit 24 including developing roller 24A, and is delivered to transfer charger 25.

Sheet P or P', supplied automatically or manually, is fed by sheet feeder 26. Then, the toner image, previously formed on drum 20, is transferred to the surface of sheet P (P') by transfer charger 25. Thereafter, sheet P (P') is separated from drum 20 by separation charger 27 utilizing AC corona discharge, and fed along transport path 28. The toner image is fused to sheet P (P') by fixing unit 29, and the sheet is discharged into detachable tray 3 by exit rollers 30.

Meanwhile, the residual toner, remaining on the surface of drum 20 after the transfer of the toner image to the sheet, is removed by cleaning unit 31. The potential on drum 20 is lowered below the predetermined level by bypass slit beam 32 which diverges from a light beam from exposure lamp 22. Thus, the apparatus is ready for the next cycle of copying operation.

The function of the cleaning unit will now be described.

As mentioned before, the cleaning unit serves to remove the untransferred toner remaining on photosensitive drum 20 without being transferred to sheet P (P') as transfer paper. The distal end of cleaning blade 66, held by blade holder 67, projects in the opposite direction to rotating direction b' of drum 20 to touch it, thereby effecting the cleaning function.

Prior to the start of the copying cycle, a very small amount of lubricant WX is applied to the edge portions of nonvisible-image corresponding regions a of blade 66 of cleaning unit 24. As a result, blade 66 serves as a low-friction blade. Lubricant WX on the distal end portion of blade 66 is fed onto the peripheral surface of photosensitive drum 20 to form a very thin film thereon as the drum rotates. Accordingly, drum 20 becomes a low-friction member, and the film serves as a protective film. Meanwhile, the toner used in the preceding copying cycles, which is deposited on visible-image region x of drum 20, serves as a lubricant. Thus, lubricant WX is always present between blade 66 and drum 20, greatly reducing the frictional stress between them.

Since photosensitive drum 20 is lubricated as well as blade 66 to which lubricant WX is applied, as described above, the frictional stress between photosensitive drum 20 and blade 66 is reduced without impeding their functions. Thus, the primary functions of drum 20 and blade 66 can be fulfilled without the drawbacks of the prior art apparatus. Such drawbacks including burr of blade 66 due to great frictional stress between blade and drum, damage to the drum surface, and drum filming. The eliminated drawbacks further include defective images produced by frictional charge between blade and drum, cleaning errors caused by the reduction of the frictional stress between the two members, etc.

The aforementioned process of initial setting will be described in detail.

When using a brand-new photosensitive drum or a replaced one, for example, the toner is not deposited on visible-image region x of the drum. If the drum is used as it is, therefore, a high frictional resistance is caused between drum and blade. Thereupon, the conventional initial setting process is employed in which an inverse developing bias is applied during the first revolution of the drum. According to the present invention, however, regions a of the blade are coated with wax, so that the nonvisible-image regions without the toner thereon can be coated with a lubricant. Thus, the apparatus of the invention is free from the conventional drawbacks, such as burr of the blade, drum filming, damage to the drum, etc. If the inverse bias is applied, the toner is deposited on region y of FIG. 6. In this case, a toner layer may naturally be formed in regions a.

The following are examples of materials and other particulars of the members used in the above described embodiment.

Photosensitive drum: Selenium.

Lubricant: Coating, pasting or lamination of polytetrafluoroethylene, polypropylene-based wax, fluorine-contained compound, polyvinylidene fluoride, or molybdenum disulfide.

Blade: Polyurethane, 74 in hardness.

Coating, pasting or lamination thickness: approximately 1 micron to 5 microns (with use of a binder between lubricant and blade for coating, pasting or lamination).

Blade thickness: Two millimeters.

Edge accuracy: Approximately 6 microns.

A lubricant layer can be formed on the blade in such a manner that it will no longer exist when 20 to 30 cycles of copying operation are performed after the image forming apparatus has been initially set. When the lubricant layer is thus removed, the blade is already in a smooth, sliding contact with the drum, then the drum is being contacted with a high edge precision of the blade.

What is claimed is:

1. A cleaning device for use in an image-forming apparatus, for removing a residual developer from a photosensitive member having an image-forming region and a non-image-forming region, comprising:

a cleaning blade including a first longitudinal distal end portion which contacts the photosensitive member, and a second longitudinal distal end portion; and a lubricant layer formed on said second longitudinal distal end portion, the lubricant layer contacting the photosensitive member so that the frictional stress between the photosensitive member and the second distal end portion is reduced.

2. The cleaning device according to claim 1, wherein said lubricant layer is used in an initial setting process for the photosensitive member.

3. The cleaning device according to claim 1, wherein said lubricant layer includes a layer of lubricant powder of polytetrafluoroethylene or polyvinylidene fluoride with a thickness of approximately 1 micron to 5 microns formed on the blade with use of a binder for adhesion between the layer and the blade.

4. The cleaning device according to claim 1, wherein said lubricant layer and said first distal end portion contact the non-image-forming region and the image-forming region of the photosensitive member, respectively.

5. The cleaning device according to claim 4 wherein said lubricant layer is coated on the second distal end portion so that lubricant of the lubricant layer is deposited on the non-image-forming region of the photosensitive member, so as to form a thin lubricant film thereon, by the movement of the photosensitive member.

6. A cleaning device for use in an image-forming apparatus, for removing residual developer from a photosensitive member including an image-forming region and a non-image-forming region, comprising:

a cleaning blade including first and second longitudinal distal end portions; and a lubricant layer formed on the second longitudinal distal end portion, the lubricant layer contacting the photosensitive member so that the frictional stress between the photosensitive member and the second longitudinal distal end portion decreases, the lubricant layer being a lubricant powder and having a predetermined thickness, so that lubricant of the lubricant layer is deposited only in the non-image-forming region of the photosensitive member, so as to form a thin lubricant film thereon, by the movement of the photosensitive member, and the lubricant layer is gradually removed from the second longitudinal distal end portion during a copying operation.

7. The cleaning device according to claim 6, wherein said lubricant layer is used in an initial setting process for the photosensitive member.

8. The cleaning device according to claim 6, wherein said lubricant layer includes a layer of lubricant powder of polytetrafluoroethylene or polyvinylidene fluoride with a thickness of approximately 1 micron to 5 microns formed on the blade with use of a binder for adhesion between the layer and the blade.

9. A process for initially setting a photosensitive member in an image-forming apparatus having a photosensitive member and a cleaning blade therefor, said process comprising the steps of:

positioning the photosensitive member within the image-forming apparatus;

coating the longitudinal distal end portions of the cleaning blade with a lubricant;

applying an inverse developing bias to the photosensitive member to coat the image-forming regions thereof with developer; and gradually transferring and maintaining a lubricant film on non-image-forming regions of the photosensitive member by operational contact between the lubricant coated longitudinal distal end portions of the cleaning blade and the non-image-forming regions of the photosensitive member, said lubricant being gradually removed from the longitudinal distal end portions during a copying operation.

* * * * *